US012758893B2

(12) United States Patent
Sentendrey

(10) Patent No.: US 12,758,893 B2
(45) Date of Patent: Oct. 13, 2026

(54) SIMULATIVE MIDDLE-FINGER AMUSEMENT DEVICE

(71) Applicant: Donna Sentendrey, Westlake, OH (US)

(72) Inventor: Donna Sentendrey, Westlake, OH (US)

( * ) Notice: Subject to any disclaimer, the term of this patent is extended or adjusted under 35 U.S.C. 154(b) by 317 days.

(21) Appl. No.: 18/435,053

(22) Filed: Feb. 7, 2024

(65) Prior Publication Data

US 2025/0032950 A1 Jan. 30, 2025

Related U.S. Application Data

(60) Provisional application No. 63/528,961, filed on Jul. 26, 2023.

(51) Int. Cl.
*A63H 37/00* (2006.01)
*A63H 13/00* (2006.01)

(52) U.S. Cl.
CPC ..... *A63H 37/00* (2013.01); *A63H 13/00* (2013.01)

(58) Field of Classification Search
CPC ..... A63H 11/00; A63H 5/00; A63H 33/26; A63H 446/232
See application file for complete search history.

(56) References Cited

U.S. PATENT DOCUMENTS 3,199,248 A * 8/1965 Suzuki ..... A63H 3/28 446/299
4,389,811 A * 6/1983 Iwaya ..... A63H 13/02 446/322
6,926,580 B1 * 8/2005 Wang ..... A63H 11/00 446/322
7,695,342 B1 * 4/2010 Cameron ..... A63H 13/02 446/330
2022/0399836 A1 * 12/2022 Li ..... H10N 30/853

* cited by examiner

*Primary Examiner* — Amr A Awad
(74) *Attorney, Agent, or Firm* — Brennan, Manna & Diamond, LLC

(57) ABSTRACT

A simulative middle-finger amusement device is provided. The device is comprised of bird that rotates or "flips" around a perch, which acts as a simulative middle-finger amusement device that allows a user to flip a simulative bird around a simulative branch to metaphorically "flip the bird" (i.e., flip a middle finger) at an individual.

13 Claims, 4 Drawing Sheets

SIMULATIVE MIDDLE-FINGER AMUSEMENT DEVICE

CROSS-REFERENCE TO RELATED APPLICATION

The present application claims priority to, and the benefit of, U.S. Provisional Application No. 63/528,961, which was filed on Jul. 26, 2023, and is incorporated herein by reference in its entirety.

FIELD OF THE INVENTION

The present invention relates generally to the field of amusement devices. More specifically, the present invention relates to a simulative middle-finger amusement device that allows a user to flip a simulative bird around a simulative branch to metaphorically "flip the bird" (i.e., flip a middle finger) at an individual. Accordingly, the present disclosure makes specific reference thereto. Nonetheless, it is to be appreciated that aspects of the present invention are also equally applicable to other like applications, devices, and methods of manufacture.

BACKGROUND

Many individuals have experienced the frustration of being cut off in traffic or enduring an encounter with a particularly irritating driver. During this experience, it is not uncommon to feel a surge of anger. In these moments, the immediate impulse might be to react aggressively, perhaps by making a vulgar hand gesture, such as flipping a middle finger at the other driver. This is a universal experience for many drivers who find themselves in the heat of the moment on busy roads, feeling provoked by the actions of others. However, flipping a middle finger may further instigate a road rage incident, which is undesirable.

Therefore, there exists a long-felt need in the art for a device that can be used while driving. There also exists a long-felt need in the art for a simulative middle-finger amusement device. Further, there exists a long-felt need in the art for a simulative middle-finger amusement device that provides a user with a humorous way to defuse tense situations, allowing frustrated drivers to vent without escalating into road rage. More specifically, there exists a long-felt need in the art for a simulative middle-finger amusement device that allows a user a way to express frustration and relieve stress in a light-hearted, flippant manner using a mechanism designed to simulate the flipping of a middle finger.

The subject matter disclosed and claimed herein, in one embodiment thereof, comprises a simulative middle-finger amusement device. The device is comprised of a bird that rotates or "flips" around an axle, which acts as a simulative middle-finger amusement device that allows a user to flip a simulative bird around a simulative branch to metaphorically "flip the bird" (i.e., flip a middle finger) at an individual.

In this manner, the simulative middle-finger amusement device of the present invention accomplishes all the foregoing objectives and provides a device that provides a user with a humorous way to defuse tense situations by allowing a frustrated driver to vent without escalating an incident into road rage. More specifically, the device allows a user a way to express frustration and relieve stress in a light-hearted, flippant manner using a mechanism designed to simulate the flipping of a middle finger.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a simulative middle-finger amusement device. The device is comprised of an amusement device that provides a simulative bird that rotates (i.e., flips) around an axle to physically represent the expression "flipping the bird" which is used to refer to flipping a middle finger at an individual.

The device is comprised of a body that may resemble a twig, a branch, a perch, etc. In one embodiment, the body is secured within a base. The base may also resemble any object, item, structure, etc. Any area of the base, such as, but not limited to, the bottom surface of the base, may be comprised of at least one fastener that allows a user to attach the base (and therefore the device) to any structure, surface, etc.

The body is comprised of at least one axle. At least one bird attaches to the axle. More specifically, the bird is comprised of at least one foot which attaches around the axle via a snap or other removable fastening mechanism. During use, the axle rotates 360 degrees relative to the horizontal axis of the body, such that the bird also rotates 360 degrees when attached around the axle. The rotation of the bird "flips" the bird around the axle in order to play on the phrase "flip the bird".

The present invention is also comprised of a method of using the device. First, a device is provided comprised of a base, a bird, and a body comprised of at least one rotating axle. Then, the base can be attached to a surface via at least one fastener of the base. Next, the bird can be attached to the axle via at least one foot of the bird. Finally, a user can press the button to spin the axle (which rotates the bird with the axle) to simulate "flipping the bird".

Accordingly, the simulative middle-finger amusement device of the present invention is particularly advantageous as it provides a device to a user with a humorous way to defuse tense situations by allowing a frustrated driver to vent without escalating an incident into road rage. More specifically, the device allows a user a way to express frustration and relieve stress in a light-hearted, flippant manner using a mechanism designed to simulate the flipping of a middle finger. In this manner, the simulative middle-finger amusement device provides a fun solution to express frustration via a simulative gesture.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
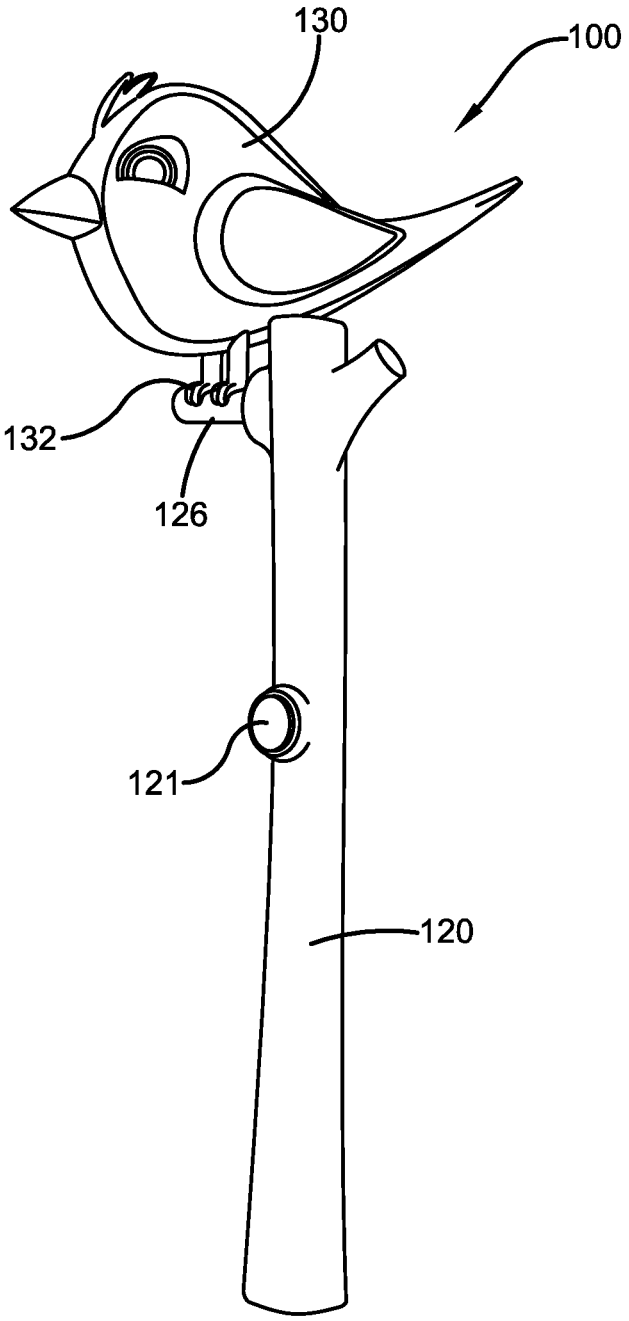
FIG. 1 illustrates a perspective view of one potential embodiment of a simulative middle-finger amusement device of the present invention in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a device that can be used while driving. There also exists a long-felt need in the art for a simulative middle-finger amusement device. Further, there exists a long-felt need in the art for a simulative middle-finger amusement device that provides a user with a humorous way to defuse tense situations, allowing frustrated drivers to vent without escalating into road rage. More specifically, there exists a long-felt need in the art for a simulative middle-finger amusement device that allows a user a way to express frustration and relieve stress in a light-hearted, flippant manner using a mechanism designed to simulate the flipping of a middle finger.

The present invention, in one exemplary embodiment, is comprised of a simulative middle-finger amusement device comprised of an amusement device that provides a simulative bird that rotates (i.e., flips) around an axle to physically represent the expression "flipping the bird" which is used to refer to flipping a middle finger at an individual.

The device is comprised of a body that may resemble a twig, a branch, a perch, etc. In one embodiment, the body is secured within a base that may also resemble any object, item, structure, etc. Any area of the base, such as, but not limited to, the bottom surface of the base, may be comprised of at least one fastener that allows a user to attach the base (and therefore the device) to any structure, surface, etc.

The body is comprised of at least one axle, wherein at least one bird attaches to the axle. More specifically, the bird is comprised of at least one foot which attaches around the axle via a snap or other removable fastening mechanism. During use, the axle rotates 360 degrees relative to the horizontal axis of the body, such that the bird also rotates 360 degrees when attached around the axle. The rotation of the bird "flips" the bird around the axle in order to play on the phrase "flip the bird".

The present invention is also comprised of a method of using the device. First, a device is provided comprised of a base, a bird, and a body comprised of at least one rotating axle. Then, the base can be attached to a surface via at least one fastener of the base. Next, the bird can be attached to the axle via at least one foot of the bird. Finally, a user can press the button to spin the axle (which rotates the bird with the axle) to simulate "flipping the bird".

Accordingly, the simulative middle-finger amusement device of the present invention is particularly advantageous as it provides a device to a user with a humorous way to defuse tense situations by allowing a frustrated driver to vent without escalating an incident into road rage. More specifically, the device allows a user a way to express frustration and relieve stress in a light-hearted, flippant manner using a mechanism designed to simulate the flipping of a middle finger. In this manner, the simulative middle-finger amusement device provides a fun solution to express frustration via a simulative gesture.

Referring initially to the drawings, FIG. 1 illustrates a perspective view of one potential embodiment of a simulative middle-finger amusement device 100 of the present invention in accordance with the disclosed architecture. The device 100 is comprised of an amusement device that provides a simulative bird 130 that rotates (i.e., flips) around an axle 126. This action physically represents the expression "flipping the bird" which is used to refer to flipping a middle finger at an individual.

The device 100 is comprised of a body 120. In the preferred embodiment, the body 120 resembles a twig, a branch, a perch, etc. However, the body 120 may be any shape and size, and may resemble any object, item, structure, etc.

Figure 2:
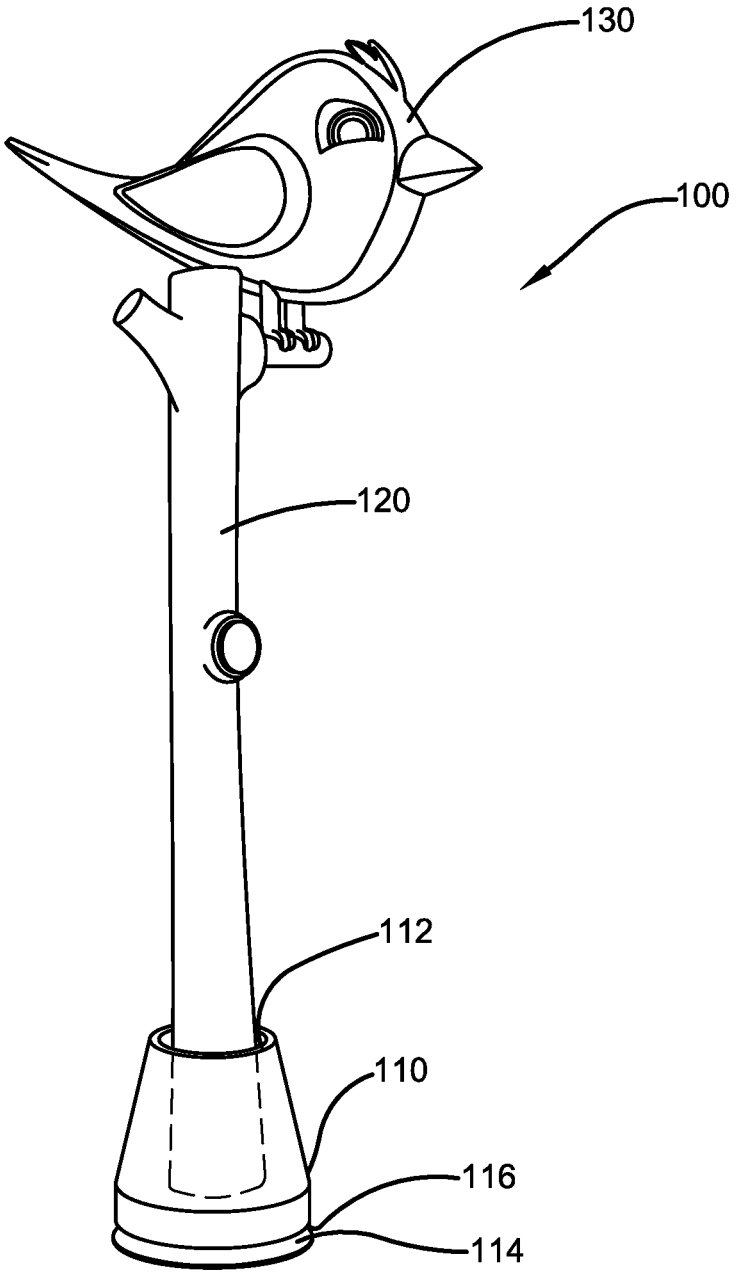
FIG. 2 illustrates a perspective view of one potential embodiment of a simulative middle-finger amusement device of the present invention in accordance with the disclosed architecture.

In one embodiment, the body 120 is secured within a base 110 via pressing the body 120 into the receiving area 112 of the base 110, as seen in FIG. 2. The base 110 may be any shape, size, and configuration. The base 110 may also resemble any object, item, structure, etc. Any area of the base 110, such as, but not limited to, the bottom surface 116 of the base 110, may be comprised of at least one fastener 114. The fastener 114 allows a user to attach the base 110 (and therefore the device 100) to any structure, surface, etc. The fastener 114 may be any fastener type known in the art including, but not limited to, suction cup, adhesive, magnet, etc.

The body 120 is comprised of at least one axle 126. The axle 126 preferably resembles the body 120 (i.e., has the same color, shape, appearance, etc., of the body 120). At least one bird 130 attaches to the axle 126. More specifically, the bird 130 is comprised of at least one foot 132 which attaches around the axle 126 via a snap or other removable fastening mechanism. The bird 130 may resemble any species, size, color, etc., of bird.

During use, the axle 126 rotates 360 degrees relative to the horizontal axis of the body 120. Therefore, the bird 130 also rotates 360 degrees when attached around the axle 126. The rotation of the bird 130 "flips" the bird 130 around the axle 126 in order to play on the phrase "flip the bird".

Figure 3:
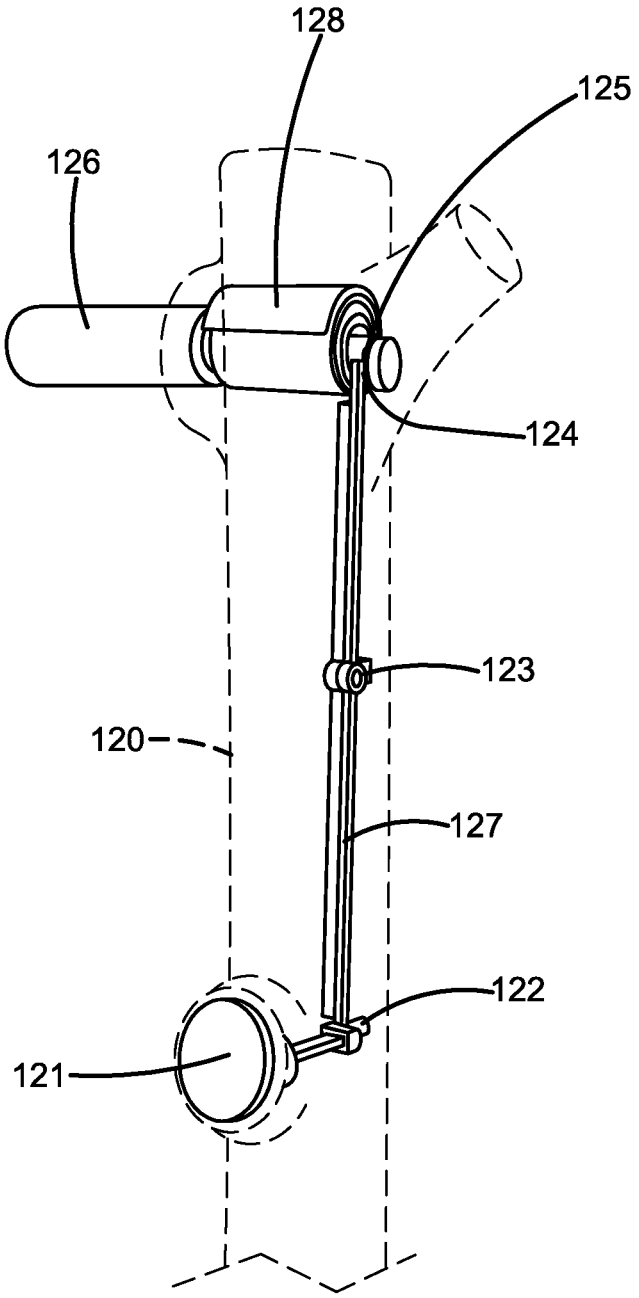
FIG. 3 illustrates a transparent view of an interior of a body of one potential embodiment of a simulative middle-finger amusement device of the present invention in accordance with the disclosed architecture.

The body 120 is comprised of a plurality of internal mechanisms that rotate the axle 126, as seen in FIG. 3. More specifically, the body 120 is comprised of at least one button 121. When pressed, the button 121 activates at least one spring mechanism 122 by compressing the mechanism 122, wherein upon the release of the button 121, stored kinetic energy within the mechanism 122 is released. Said energy is then transferred from the mechanism 122 to the axle 126 via at least one arm 127, wherein the arm 127 may rotate/move around at least one fixed pivot point 123. The device 100 may also be comprised of at least one release lever 124 that is used to control the movement of the axle 126. The device 100 may also have at least one ratchet lock 125 that may prevent the spring 122 from releasing prematurely. In addition, the device 100 may have at least one coiled spring 128 that rotates the axle 126.

Figure 4:
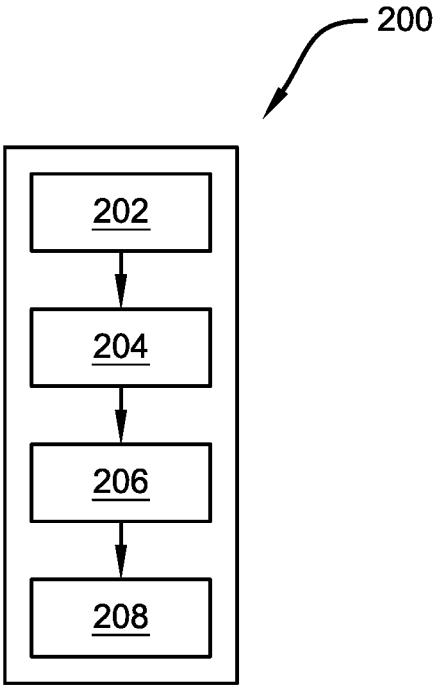
FIG. 4 illustrates a flowchart of a method of using one potential embodiment of a simulative middle-finger amusement device of the present invention in accordance with the disclosed architecture.

The present invention is also comprised of a method of using 200 the device 100, as seen in FIG. 4. First, a device 100 is provided comprised of a base 110, a bird 130, and a body 120 comprised of at least one rotating axle 126 [Step 202]. Then, the base 110 can be attached to a surface via at least one fastener 114 of the base 110 [Step 204]. Next, the bird 130 can be attached to the axle 126 via at least one foot 132 of the bird 130 and the body 110 can be placed into a receiving area 112 of the base 110 [Step 206]. Finally, a user can press the button 121 to spin the axle 126 (which rotates the bird 130 with the axle 126) to simulate "flipping the bird" [Step 208].

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "simulative middle-finger amusement device" and "device" are interchangeable and refer to the simulative middle-finger amusement device 100 of the present invention.

Notwithstanding the foregoing, the simulative middle-finger amusement device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the simulative middle-finger amusement device 100 as shown in the FIGS. are for illustrative purposes only, and that many other sizes and shapes of the simulative middle-finger amusement device 100 are well within the scope of the present disclosure. Although the dimensions of the simulative middle-finger amusement device 100 are important design parameters for user convenience, the simulative middle-finger amusement device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A simulative middle-finger amusement device comprising:
- a body;
- an axle;
- a spring;
- a ratchet lock configured to control the spring;
- a button; and
- a simulative bird comprised of a foot, wherein the foot is configured to snap onto the axle,
- wherein the axel is rotated to by pressing the button to rotate the body.

2. The simulative middle-finger amusement device of claim 1, wherein the body resembles a branch.

3. The simulative middle-finger amusement device of claim 1, wherein the axle resembles a branch.

4. The simulative middle-finger amusement device of claim 1, wherein the axle rotates 360 degrees relative to the horizontal axis of the body.

5. A simulative middle-finger amusement device comprising:
- a body comprised of an axle, a spring, and a button;
- a base comprised of a receiving area and a fastener;
- and a bird comprised of a foot; and
- wherein the body is configured to press fit into the receiving area of the base to secure the body to the base; and
- further wherein the fastener is an adhesive fastener positioned on a bottom surface of the base configured to secure the base to a surface, and wherein the axle is rotated by pressing the button to rotate the body.

6. The simulative middle-finger amusement device of claim 5, wherein the body resembles a branch.

7. The simulative middle-finger amusement device of claim 5, wherein the axle resembles a branch.

8. The simulative middle-finger amusement device of claim 5, wherein the axle rotates 360 degrees relative to the horizontal axis of the body.

9. The simulative middle-finger amusement device of claim 5, wherein the foot removably attaches to the axle.

10. A method of using a simulative middle-finger amusement device, the method comprising the following steps:
- providing a simulative middle-finger amusement device comprised of a base, a bird, and a body comprised of a rotating axle;
- attaching the base to a surface via a fastener of the base;
- attaching the bird to the axle via a foot of the bird and placing the body into a receiving area of the base; and pressing the button to spin the axle to rotate the bird; and
- using a release lever to control movement of the axle, wherein the fastener is an adhesive fastener positioned on a bottom surface of the base configured to secure the base to a surface.

11. The method of using a simulative middle-finger amusement device of claim 10, wherein the body resembles a branch.

12. The method of using a simulative middle-finger amusement device of claim 10, wherein the axle resembles a branch.

13. The method of using a simulative middle-finger amusement device of claim 10, wherein the simulative middle-finger amusement device is comprised of a spring.

* * * * *